US009291163B2

(12) United States Patent
Miyaki et al.

(10) Patent No.: US 9,291,163 B2
(45) Date of Patent: Mar. 22, 2016

(54) PUMP HAVING FITTING PORTIONS

(71) Applicant: JTEKT Corporation, Osaka-shi (JP)

(72) Inventors: Junichi Miyaki, Anjo (JP); Takatoshi Sakata, Yamatotakada (JP)

(73) Assignee: JTEKT CORPORATION, Osaka-shi (JP)

( * ) Notice: Subject to any disclaimer, the term of this patent is extended or adjusted under 35 U.S.C. 154(b) by 88 days.

(21) Appl. No.: 14/218,038

(22) Filed: Mar. 18, 2014

(65) Prior Publication Data

US 2014/0286809 A1 Sep. 25, 2014

(30) Foreign Application Priority Data

Mar. 21, 2013 (JP) ..... 2013-058348

(51) Int. Cl.

| | |
|---|---|
| ***F04C 2/10*** | (2006.01) |
| ***F04C 14/26*** | (2006.01) |
| ***F04C 15/00*** | (2006.01) |
| ***F01C 21/10*** | (2006.01) |

(52) U.S. Cl.

CPC ..... *F04C 2/105* (2013.01); *F01C 21/10* (2013.01); *F04C 2/102* (2013.01); *F04C 14/26* (2013.01); *F04C 15/0092* (2013.01)

(58) Field of Classification Search

CPC ..... F04C 2/102; F04C 2/105; F04C 14/24; F04C 14/26; F04C 15/0092

USPC ..... 418/166, 171, 270; 137/538, 540

See application file for complete search history.

(56) References Cited

U.S. PATENT DOCUMENTS

| | | | | |
|---|---|---|---|---|
| 3,574,489 | A * | 4/1971 | Pierrat | 418/171 |
| 5,722,815 | A | 3/1998 | Cozens | |
| 6,113,360 | A | 9/2000 | Yu et al. | |
| 6,481,458 | B2 * | 11/2002 | Hirano et al. | 137/538 |
| 2008/0025851 | A1 | 1/2008 | White et al. | |
| 2008/0206078 | A1 * | 8/2008 | Yamamoto et al. | 417/410.4 |
| 2010/0008797 | A1 | 1/2010 | Yukitake | |

FOREIGN PATENT DOCUMENTS

| | | |
|---|---|---|
| GB | 2 342 398 A | 4/2000 |
| JP | 2008-151065 | 7/2008 |

OTHER PUBLICATIONS

Extended European Search Report issued May 27, 2014 in Patent Application No. 14160628.5.

* cited by examiner

*Primary Examiner* — Theresa Trieu

(74) *Attorney, Agent, or Firm* — Oblon, McClelland, Maier & Neustadt, L.L.P.

(57) ABSTRACT

A pump includes a second housing member in which a suction-side groove and a discharge-side groove are formed at a predetermined interval in a circumferential direction of a bottom of a pump chamber so as to be recessed in the bottom of the pump chamber. Fitting portions that are fitted to bosses are formed on an outer surface of the second housing member. A protruding portion, which overlaps with the bosses in a thickness direction, is formed so as to protrude from a surface of the housing on which the fitting portions are formed. A relief valve is provided in the protruding portion, and the relief valve discharges fluid from the discharge-side groove when pressure in the discharge-side groove is equal to or higher than predetermined pressure.

2 Claims, 8 Drawing Sheets

SEEN IN DIRECTION SHOWN BY ARROWS B

SECTION TAKEN ALONG LINE C–C

SEEN IN DIRECTION SHOWN BY ARROW D

PUMP HAVING FITTING PORTIONS

INCORPORATION BY REFERENCE

The disclosure of Japanese Patent Application No. 2013-058348 filed on Mar. 21, 2013 including the specification, drawings and abstract, is incorporated herein by reference in its entirety.

BACKGROUND OF THE INVENTION

1. Field of the Invention

The present invention relates to a pump that sucks in and discharges fluid such as oil.

2. Description of Related Art

A vehicle having a start-stop function is generally provided with an electric oil pump. In such a vehicle, while idling is stopped, the required minimum hydraulic pressure is supplied to portions requiring hydraulic pressure by an electric oil pump, instead of a mechanical pump that is driven by an engine. Accordingly, the vehicle can be quickly restarted.

The aforementioned electric oil pump includes an outer rotor, an inner rotor, and a housing. Internal teeth are formed on the inner periphery of the outer rotor. The internal teeth are formed using trochoid curves. External teeth are formed on the outer periphery of the inner rotor. The external teeth are formed using trochoid curves and mesh with the internal teeth. The inner rotor is rotated by a motor. A pump chamber, in which the outer rotor and the inner rotor are rotatably housed, is defined in the housing.

A suction flow passage and a discharge flow passage, which communicate with the pump chamber, are formed in the housing. A suction-side groove with which the suction flow passage communicates and a discharge-side groove with which the discharge flow passage communicates are formed at an interval in the circumferential direction of the bottom of the pump chamber so as to be recessed in the bottom of the housing. When the inner rotor and the outer rotor of the electric oil pump, which has the above-mentioned configuration, are rotated while meshing with each other, oil sucked from the suction flow passage is discharged from the discharge flow passage.

Japanese Patent Application Publication No. 2008-151065 (JP 2008-151065 A) proposes an electric oil pump including a relief valve that returns oil to a suction-side groove from a discharge-side groove when excessive pressure is applied to a discharge side of a pump chamber.

This electric oil pump may be fitted to bosses protruding from an outer surface portion of a transmission. The relief valve is provided between inner and outer rotors and an outer surface of the transmission. Therefore, the thickness of the electric oil pump is increased by the thickness of the relief valve, and thus, the electric oil pump is not easily fitted to the transmission.

SUMMARY OF THE INVENTION

An object of the invention is to provide a pump with a relief valve, whose thickness dimension is prevented from being increased.

According to an aspect of the invention, there is provided a pump that is fitted to bosses protruding from a fitting target portion, the pump including a housing in which a pump chamber that is a columnar space is defined, and a suction-side groove and a discharge-side groove are formed at a predetermined interval in a circumferential direction of a bottom of the pump chamber so as to be recessed in the bottom of the pump chamber; an outer rotor that is rotatably provided in the pump chamber and includes internal teeth formed at an inner peripheral side of the outer rotor; and an inner rotor that is provided inside the internal teeth, the inner rotor including external teeth that mesh with the internal teeth and are formed at an outer peripheral side of the inner rotor, wherein fitting portions that are fitted to the bosses are formed on an outer surface of the housing, wherein a protruding portion, which overlaps with the bosses in a thickness direction, is formed so as to protrude from a surface of the housing on which the fitting portions are formed, and wherein a relief valve is provided in the protruding portion, and the relief valve discharges fluid from the discharge-side groove when pressure in the discharge-side groove is equal to or higher than predetermined pressure.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
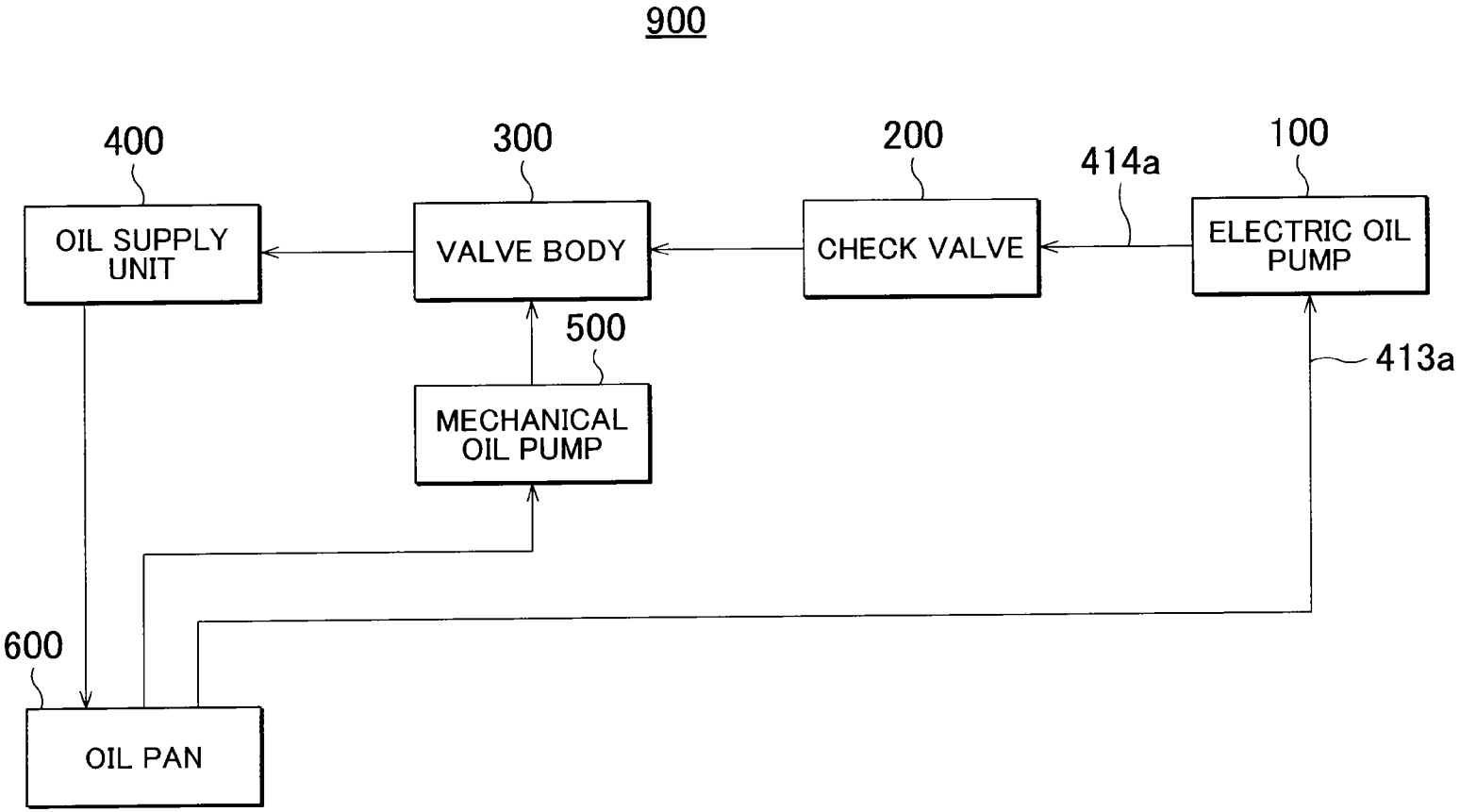
FIG. 1 is an explanatory diagram of an oil flow passage in a vehicle on which an electric oil pump according to an embodiment of the invention is provided.

A pump according to an embodiment of the invention will be described below with reference to the drawings. First, an oil flow passage in a vehicle 900 in which an electric oil pump 100 according to this embodiment is provided will be described with reference to FIG. 1. The vehicle 900 includes an electric oil pump 100, a check valve 200, a valve body 300, an oil supply unit 400, a mechanical oil pump 500, and an oil pan 600.

The electric oil pump 100 is a pump in which a pump body 10 (see FIG. 2) is driven by a motor 20. The electric oil pump 100 sucks in oil from the oil pan 600, and supplies the oil to the oil supply unit 400 through the check valve 200 and the valve body 300. The electric oil pump 100 will be described in detail below.

The check valve 200 is provided between a discharge flow passage 19*d* (see FIGS. 2 and 3) of the electric oil pump 100 and the valve body 300. The check valve 200 allows oil to flow to the valve body 300 from the electric oil pump 100, but prevents oil from flowing backward to the electric oil pump 100 from the valve body 300.

The mechanical oil pump 500 is driven by a rotational drive force of an engine (not shown). The mechanical oil pump 500 sucks in oil from the oil pan 600 and supplies the oil to the oil supply unit 400 through the valve body 300. The mechanical oil pump 500 does not supply oil when the engine stops.

In the valve body 300, an inflow-side flow passage, through which oil flows into the valve body 300, is switched to the electric oil pump 100 (check valve 200)-side flow passage or the mechanical oil pump 500-side flow passage, in accordance with a command that is sent from a vehicle ECU (not shown).

For example, the oil supply unit 400 is a transmission that reduces the speed of rotation, which is input from the engine (not shown), at a predetermined speed ratio and outputs the rotation, whose speed has been reduced, to a differential, a torque converter that amplifies running torque output from an output shaft of the engine and inputs the amplified running torque to the transmission, or the like.

The oil pan 600 stores oil that is supplied to the oil supply unit 400 and is discharged from the oil supply unit 400.

The electric oil pump 100 includes the pump body 10 and the motor 20. The pump body 10 is driven by the motor 20, and supplies oil, which has a predetermined hydraulic pressure, to the oil supply unit 400 during idling stop (when the engine stops). The pump body 10 will be described in detail below.

The motor 20 outputs a rotational drive force to the pump body 10. The motor 20 includes a stator 22, a rotor 23, and a rotating shaft 24 of the rotor 23. The stator 22 is fixed to a housing 21 and is formed of coils. The rotor 23 is rotatably provided on the inner peripheral side with respect to the stator 22, and is formed of a permanent magnet.

The structure of the pump body 10 will be described below with reference to FIGS. 2 and 3. The pump body 10 includes a first housing member 11, an inner rotor 12, an outer rotor 13, a seal member 14, a relief valve 15, and a second housing member 19. In the following description, a thickness direction z of the electric oil pump 100 or the second housing member 19 signifies the direction of the rotational axis of the inner rotor 12 or the outer rotor 13. Further, a plane direction of the second housing member 19 is a direction of an XY plane that is orthogonal to the thickness direction z.

The first housing member 11 is in the form of a block, and has a bottomed tubular shape in which a pump chamber 11*b*, that is, a flat columnar space is defined. As shown in FIG. 2, an insertion hole 11*a* communicating with the pump chamber 11*b* is formed at the center of the first housing member 11. The rotating shaft 24 of the motor 20 is inserted into the insertion hole 11*a*. A ring-shaped seal member 14, which is in contact with the rotating shaft 24 over the entire circumference and seals a gap between the first housing member 11 and the rotating shaft 24, is provided in the insertion hole 11*a*.

Figure 3:
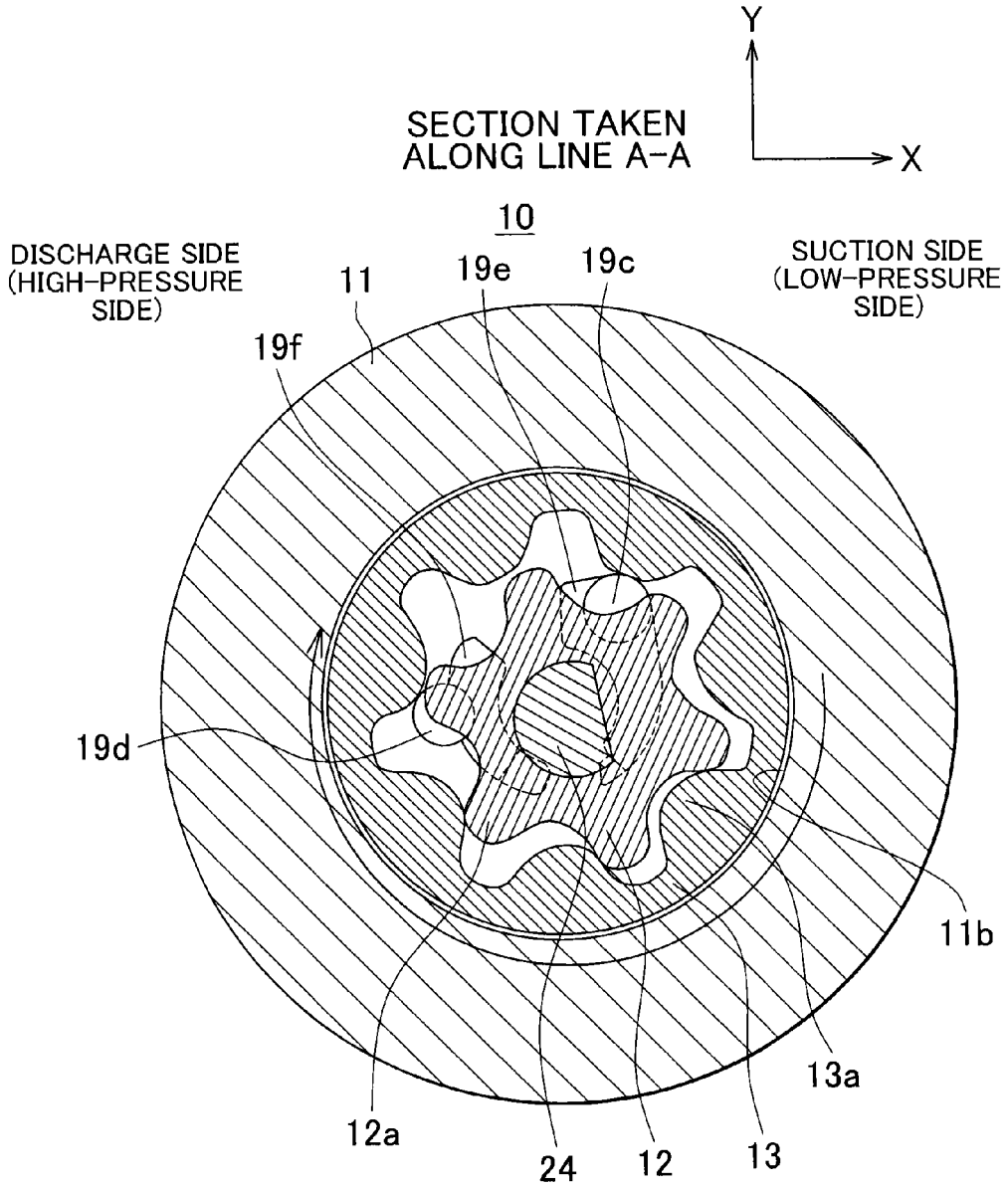
FIG. 3 is a sectional view of a pump portion taken along a line A-A- in FIG. 2.

As shown in FIG. 3, the outer rotor 13 is rotatably provided in the pump chamber 11*b*. The outer rotor 13 is in a flat columnar shape so as to have a circular cross-sectional shape, and internal teeth 13*a*, which form a space, are formed at the inner peripheral side of the outer rotor 13. The inner rotor 12 is rotatably provided inside the internal teeth 13*a*.

The inner rotor 12 has a ring shape, and external teeth 12*a* are formed at the outer edge of the inner rotor 12. The internal teeth 13*a* and the external teeth 12*a* are formed using a plurality of trochoid curves. The number of the external teeth 12*a* is smaller than the number of the internal teeth 13*a*. The external teeth 12*a* mesh with the internal teeth 13*a*. The center of rotation of the outer rotor 13 is eccentric with respect to the center of rotation of the inner rotor 12. The center of the inner rotor 12 and the rotating shaft 24 of the motor 20 are fitted to each other, and thus, the inner rotor 12 and the rotating shaft 24 are rotated together.

Figure 4:
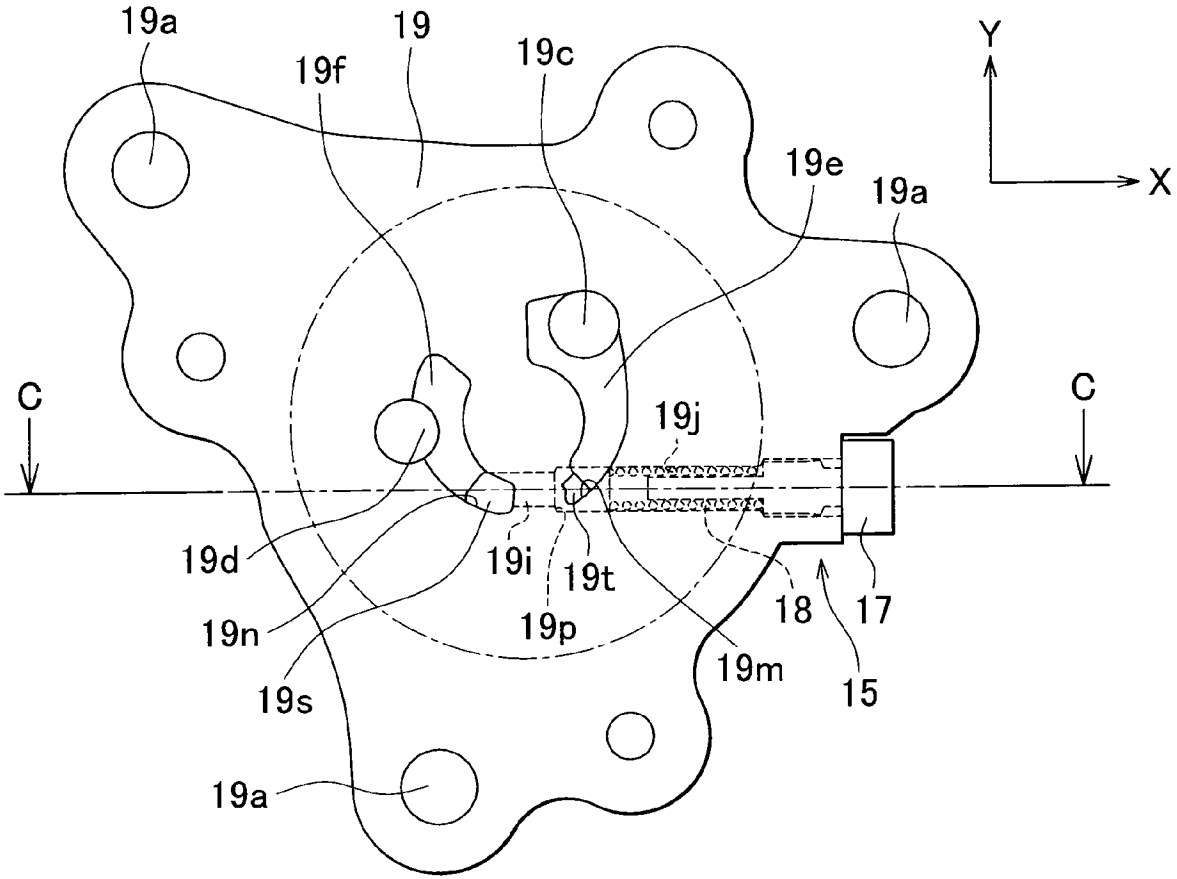
FIG. 4 is a surface view of a second housing member seen in a direction shown by arrows B in FIG. 2.

The second housing member 19 has a plate shape, and is fitted to the first housing member 11 so as to close an opening of the first housing member 11. As shown in FIGS. 2, 3, and 4, a crescent-shaped suction-side groove 19*e* and a crescent-shaped discharge-side groove 19*f* are formed at a predetermined interval in the circumferential direction of the bottom of the pump chamber 11*b* so as to be recessed in the surface of the second housing member 19 facing the pump chamber 11*b* (i.e., in the bottom of the pump chamber 11*b*).

The suction-side groove 19*e* and the discharge-side groove 19*f* face each other in the bottom of the pump chamber 11*b*. Positions at which the suction-side groove 19*e* and the discharge-side groove 19*f* are formed are present on a locus along which a space formed between the external teeth 12*a* and the internal teeth 13*a* is moved. As shown in FIG. 3, the side of the pump chamber 11*b* on which the suction-side groove 19*e* is formed is a suction side. The side of the pump chamber 11*b* on which the discharge-side groove 19*f* is formed is a discharge side.

A suction flow passage 19*c*, which communicates with the pump chamber 11*b* by communicating with the bottom of the suction-side groove 19*e*, is formed in the second housing member 19. A position where the suction flow passage 19*c* communicates with the bottom of the suction-side groove 19*e* is a start end portion of the suction-side groove 19*e* where the space formed between the external teeth 12*a* and the internal teeth 13*a* passes through the suction-side groove 19*e* first. The discharge flow passage 19*d*, which communicates with the pump chamber 11*b* by communicating with the bottom of the discharge-side groove 19*f*, is formed in the second housing member 19. A position where the discharge flow passage 19*d* communicates with the bottom of the discharge-side groove 19*f* is an intermediate portion of the discharge-side groove 19*f*.

Figure 2:
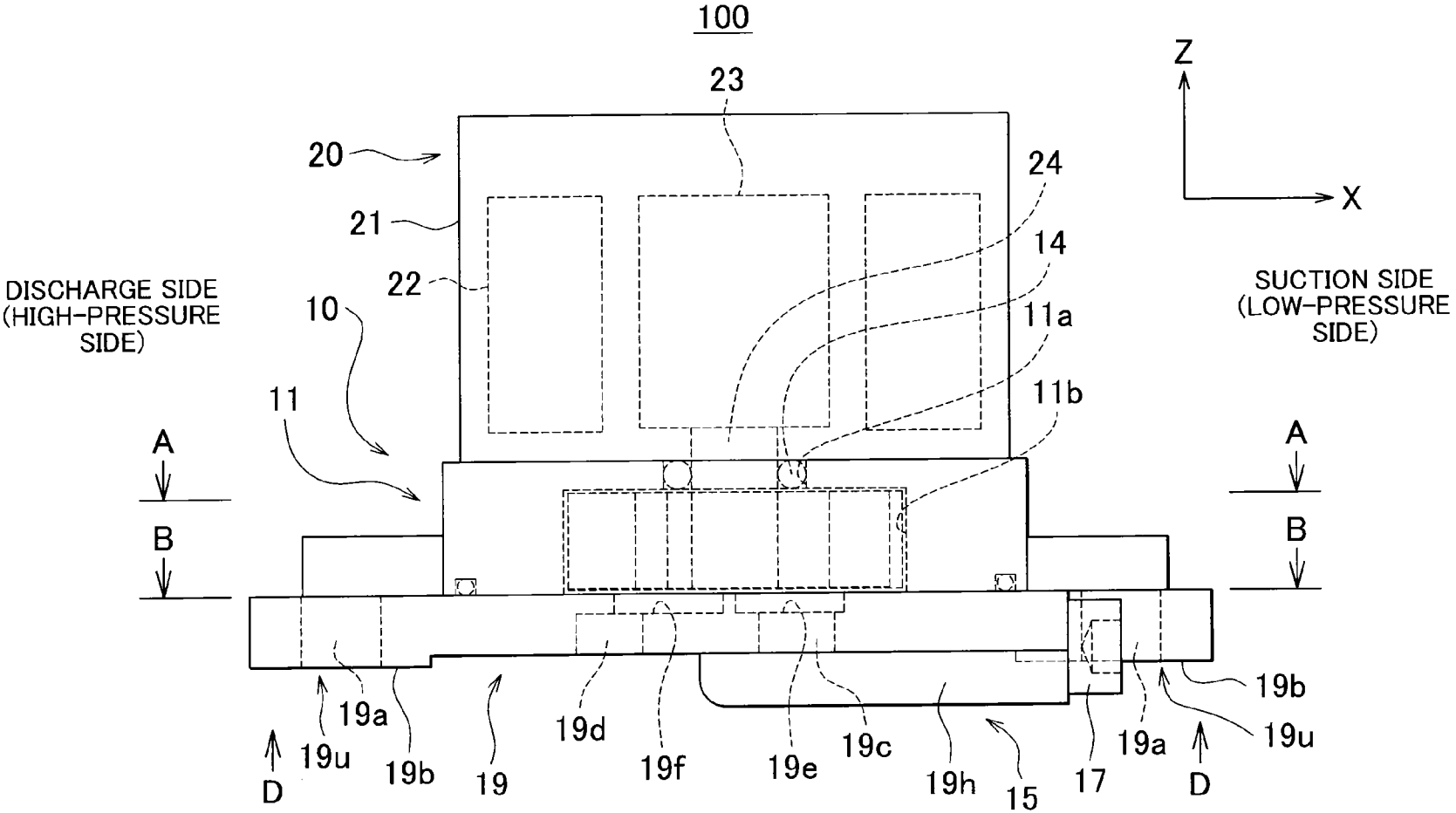
FIG. 2 is a side view of an electric oil pump.
Figure 6:
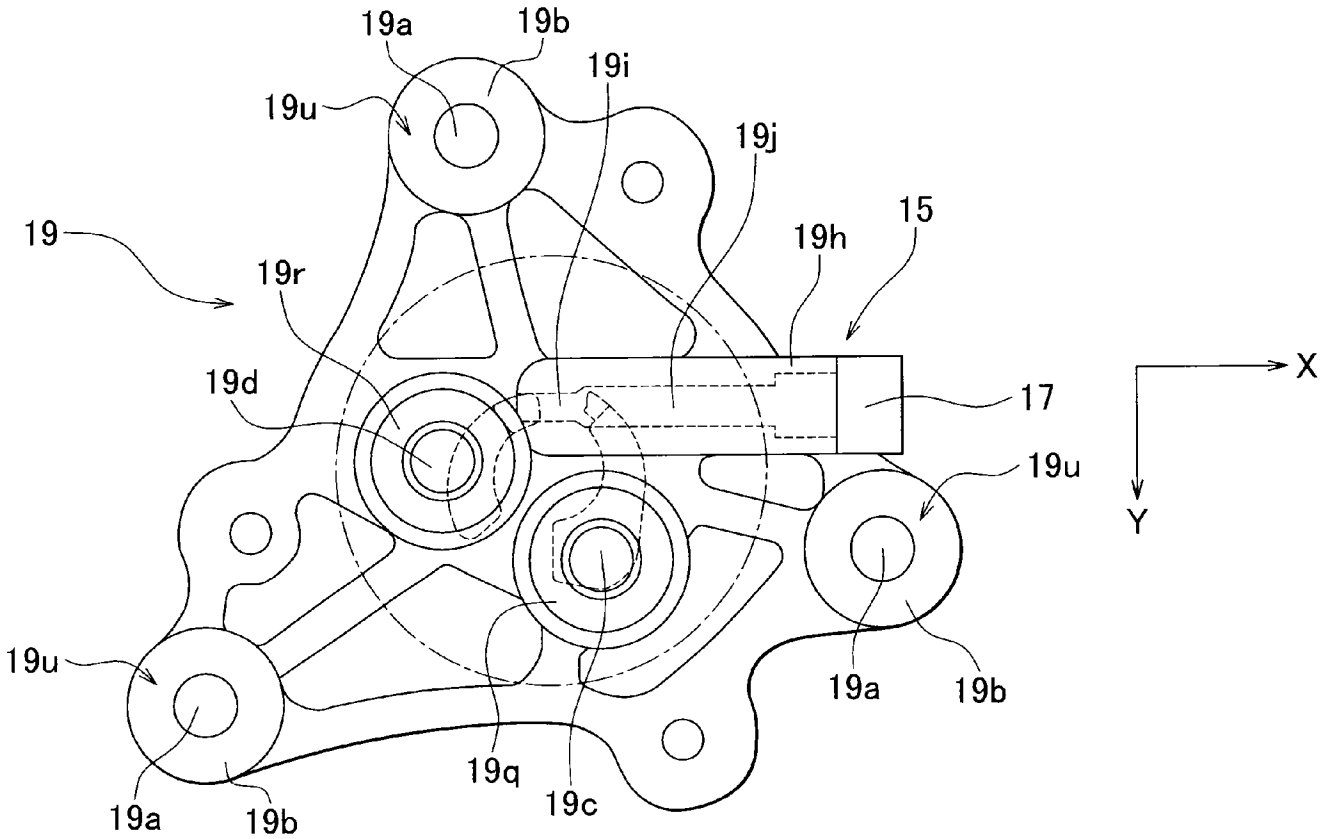
FIG. 6 is a reverse surface view of the second housing member seen in a direction shown by an arrow D in FIG. 2.
Figure 7:
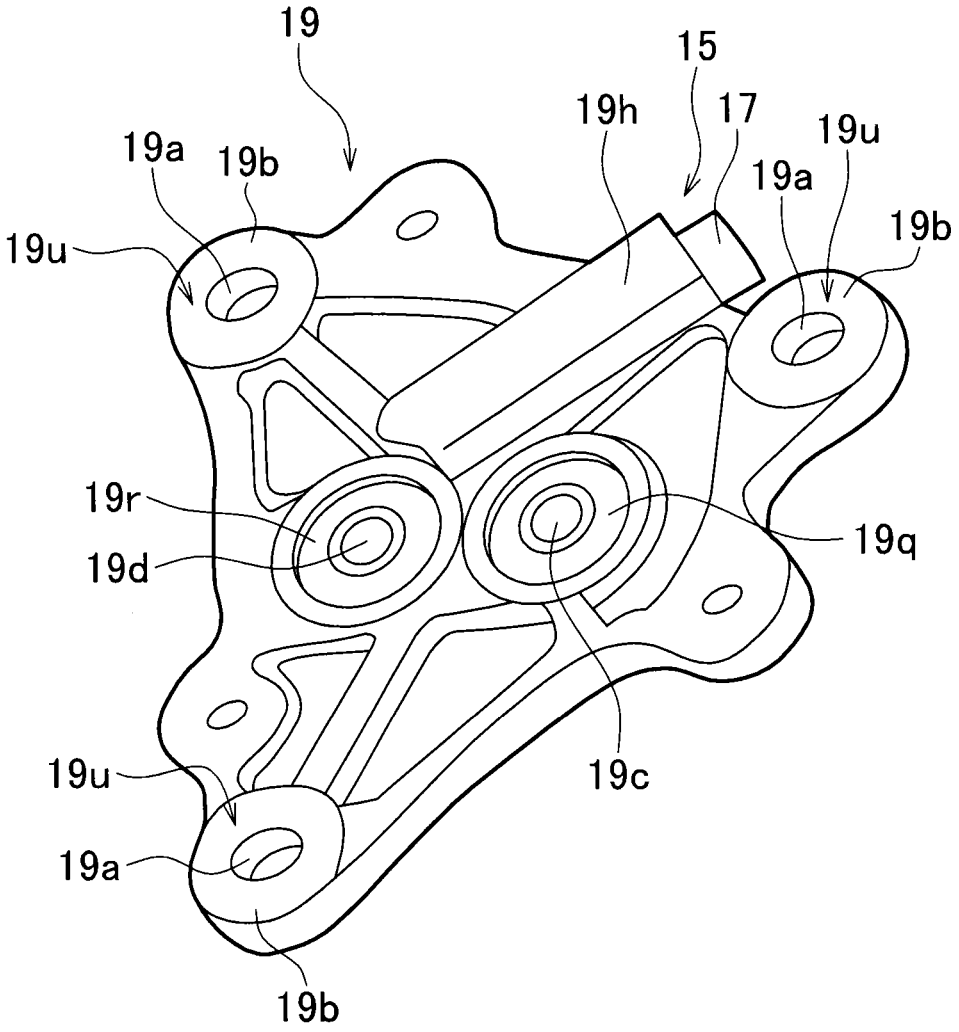
FIG. 7 is a perspective view of a reverse surface side of the second housing member.

As shown in FIGS. 2, 6, and 7, a plurality of fitting portions 19*u* is formed at an outer edge portion of a reverse surface 19*v* of the second housing member 19 (the surface of the second housing member 19 on a side opposite to the pump chamber 11*b*-side). Further, a fitting hole 19*a* is formed at each of the fitting portions 19*u*. As shown in FIGS. 6 and 7, a fitting surface 19*b*, which is a flat surface, is formed at the outer peripheral portion around the fitting hole 19*a* of each of the fitting portions 19*u*. Furthermore, annular packing fitting recesses 19*q*, 19*r* are formed so as to be recessed in the outer peripheral portions around openings of the suction flow passage 19*c* and the discharge flow passage 19*d* in the reverse surface 19*v* of the second housing member 19, respectively.

As shown in FIGS. 2, 6, and 7, a protruding portion 19*h* is formed between the fitting holes 19*a* on the reverse surface 19*v* of the second housing member 19 (the surface of the second housing member 19 on which the fitting portions 19*u* are formed). The protruding portion 19*h* is in the form of a block and protrudes in the thickness direction z. In the reverse surface 19*v* of the second housing member 19, the position of the protruding portion 19*h* in the plane direction is different from the positions at which the fitting portions 19*u* and the packing fitting recesses 19*q*, 19*r* are formed.

When the motor 20 is rotated, the inner rotor 12 is rotated and the outer rotor 13, which meshes with the external teeth 12*a* at the internal teeth 13*a*, is also rotated. Then, the space formed between the external teeth 12*a* and the internal teeth 13*a* is moved to the discharge-side groove 19*f* from the suction-side groove 19*e*, and thus, oil is supplied to the discharge flow passage 19*d* from the suction flow passage 19*c*. When the electric oil pump 100 is operated, the pressure in the discharge side (high-pressure side) of the pump chamber 11*b* is higher than the pressure at the suction side (low-pressure side) of the pump chamber 11*b*.

Figure 5:
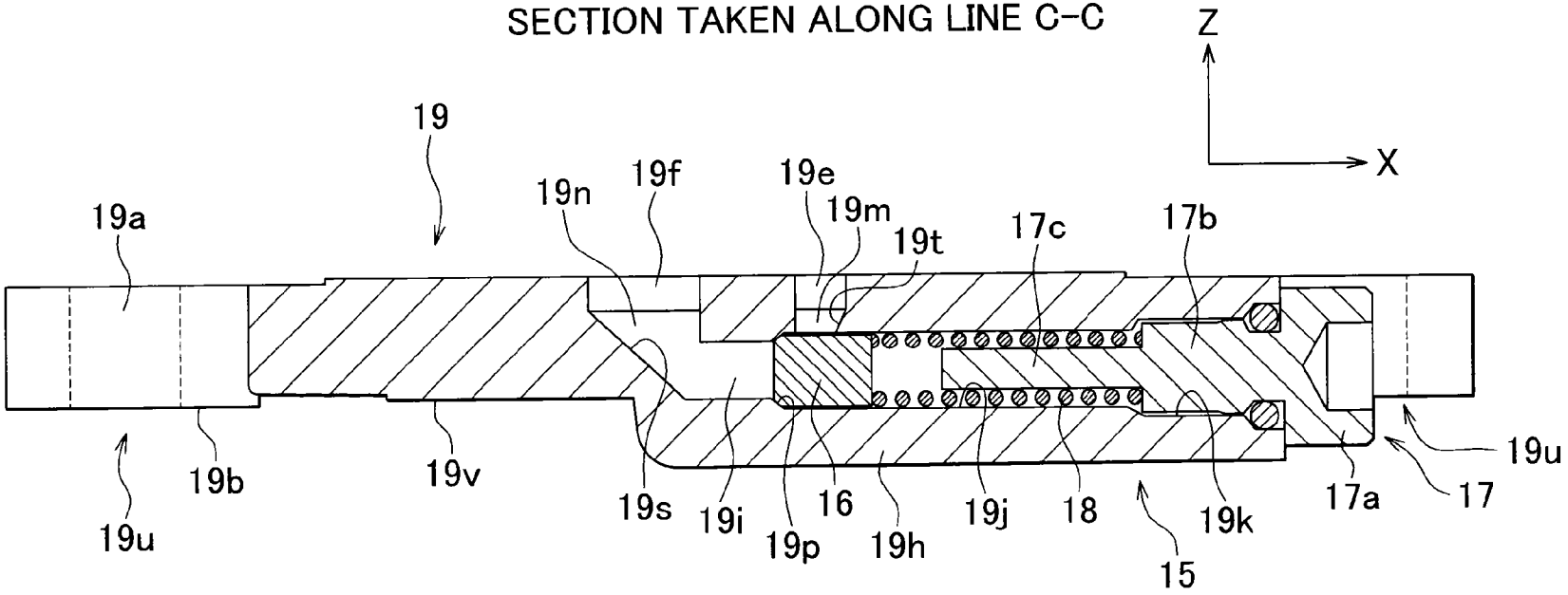
FIG. 5 is a sectional view of a relief valve taken along a line C-C in FIG. 4.

Next, the relief valve 15 will be described with reference to FIG. 5. As shown in FIG. 5, the relief valve 15 includes a suction-side relief recess 19*m*, a discharge-side relief recess 19*n*, a relief flow passage 19*i*, a spool 16, a spring receiving member 17, and a spring 18.

As shown in FIGS. 4 and 5, the suction-side relief recess 19*m*, which is recessed in the thickness direction z, is formed at the bottom of the suction-side groove 19*e*. The discharge-side relief recess 19*n*, which is recessed in the thickness direction z, is formed at the bottom of the discharge-side groove 19*f*. The positions of the suction-side relief recess 19*m* and the discharge-side relief recess 19*n* in the plane direction correspond to a position at which the protruding portion 19*h* is formed.

In this embodiment, a position at which the suction-side relief recess 19*m* is formed is a terminal end portion of the suction-side groove 19*e* where the space formed between the external teeth 12*a* and the internal teeth 13*a* passes through the suction-side groove 19*e* at the end. A position at which the discharge-side relief recess 19*n* is formed is a start end portion of the discharge-side groove 19*f* where the space formed between the external teeth 12*a* and the internal teeth 13*a* passes through the discharge-side groove 19*f* first.

As shown in FIGS. 4 and 5, the relief flow passage 19*i*, which provides communication between the suction-side relief recess 19*m* and the discharge-side relief recess 19*n*, is formed in the protruding portion 19*h* and in a portion of the second housing member 19 corresponding to the position at which the protruding portion 19*h* is formed in the plane direction. The relief flow passage 19*i* extends along the longitudinal direction of the protruding portion 19*h*.

A spring receiving hole 19*j*, which communicates with the relief flow passage 19*i* and is opened to an outer end of the protruding portion 19*h*, is formed in the protruding portion 19*h* and in the portion of the second housing member 19 corresponding to the position at which the protruding portion 19*h* is formed in the plane direction. The spring receiving hole 19*j* extends along the longitudinal direction of the protruding portion 19*h*.

The inside diameter of a connected portion of the relief flow passage 19*i*, which is connected to the spring receiving hole 19*j*, is larger than the inside diameter of a portion of the relief flow passage 19*i* other than this connected portion, and the connected portion of the relief flow passage 19*i* forms a receiving portion 19*p* that has the same inside diameter as the inside diameter of the spring receiving hole 19*j*. A screw groove 19*k* is formed on the inner peripheral surface of an opened side of the spring receiving hole 19*j*.

A bottom 19*s* of the discharge-side relief recess 19*n* is formed of an inclined surface that is gradually inclined toward a portion of the relief flow passage 19*i* connected to the suction-side relief recess 19*m*, in a direction toward the lower side in the thickness direction of the second housing member 19. Similarly, a bottom 19*t* of the suction-side relief recess 19*m* is formed of an inclined surface that is gradually inclined toward a portion of the relief flow passage 19*i* connected to the discharge-side relief recess 19*n*, in a direction toward the lower side in the thickness direction of the second housing member 19.

The spring receiving member 17 includes a head portion 17*a*, a spring receiving portion 17*b*, and a stopper portion 17*c* that are formed in this order from a base end of the spring receiving member 17 toward a distal end of the spring receiving member 17. A screw groove is formed on the outer peripheral surface of the spring receiving portion 17*b*. The spring receiving member 17 is fitted to the protruding portion 19*h* so that the spring receiving portion 17*b* is screwed to the screw groove 19*k* to close the opening of the spring receiving hole 19*j*. The stopper portion 17*c* is inserted into the spring receiving hole 19*j*.

The spool 16 has a block shape corresponding to the shape of the receiving portion 19*p* of the relief flow passage 19*i*, and has a columnar shape in this embodiment. The spool 16 is slidably provided in the receiving portion 19*p*.

The spring 18 is provided in a space between the spring receiving hole 19*j* and the stopper portion 17*c*. In other words, the stopper portion 17*c* is inserted in the spring 18. One end of the spring 18 is in contact with the spring receiving portion 17*b*, and the other end of the spring 18 is in contact with the spool 16. The spool 16 is pressed against the receiving portion 19*p* by the spring 18. Since the relief flow passage 19*i* is closed by the spool 16 in this state, the relief flow passage 19*i* and the suction-side groove 19*e* do not communicate with each other.

When the flow of oil from the electric oil pump 100 to the oil supply unit 400 is inhibited due to, for example, the check valve 200 shown in FIG. 1 being stuck, when oil flows backward to the discharge side of the pump chamber 11*b* from the check valve 200 through the discharge flow passage 19*d*, or when the flow rate of oil discharged from the pump body 10 is large relative to the leakage rate of oil in the oil supply unit 400, the hydraulic pressure in the discharge side of the pump chamber 11*b* or the discharge-side groove 19*f* is increased.

When hydraulic pressure in the discharge-side groove 19*f* (the discharge side of the pump chamber 11*b*) is equal to or higher than opening pressure, the spool 16 slides toward the spring receiving member 17-side against an urging force of the spring 18. Accordingly, the relief flow passage 19*i* and the suction-side relief recess 19*m* communicate with each other, and thus, the discharge-side groove 19*f* and the suction-side groove 19*e* communicate with each other through the relief flow passage 19*i*.

Then, oil present in the discharge-side groove 19*f* flows in the relief flow passage 19*i* and is discharged to the suction-side groove 19*e*. The urging force of the spring 18 is set to an urging force that allows the spool 16 to slide so that the discharge-side groove 19*f* and the suction-side groove 19*e* communicate with each other through the relief flow passage 19*i* when hydraulic pressure in the discharge-side groove 19*f* is equal to or higher than the opening pressure.

The slide of the spool 16 toward the spring receiving member 17-side is restricted by the stopper portion 17*c*, and thus, the spring 18 is prevented from being broken by excessive slide of the spool 16.

Figure 8:
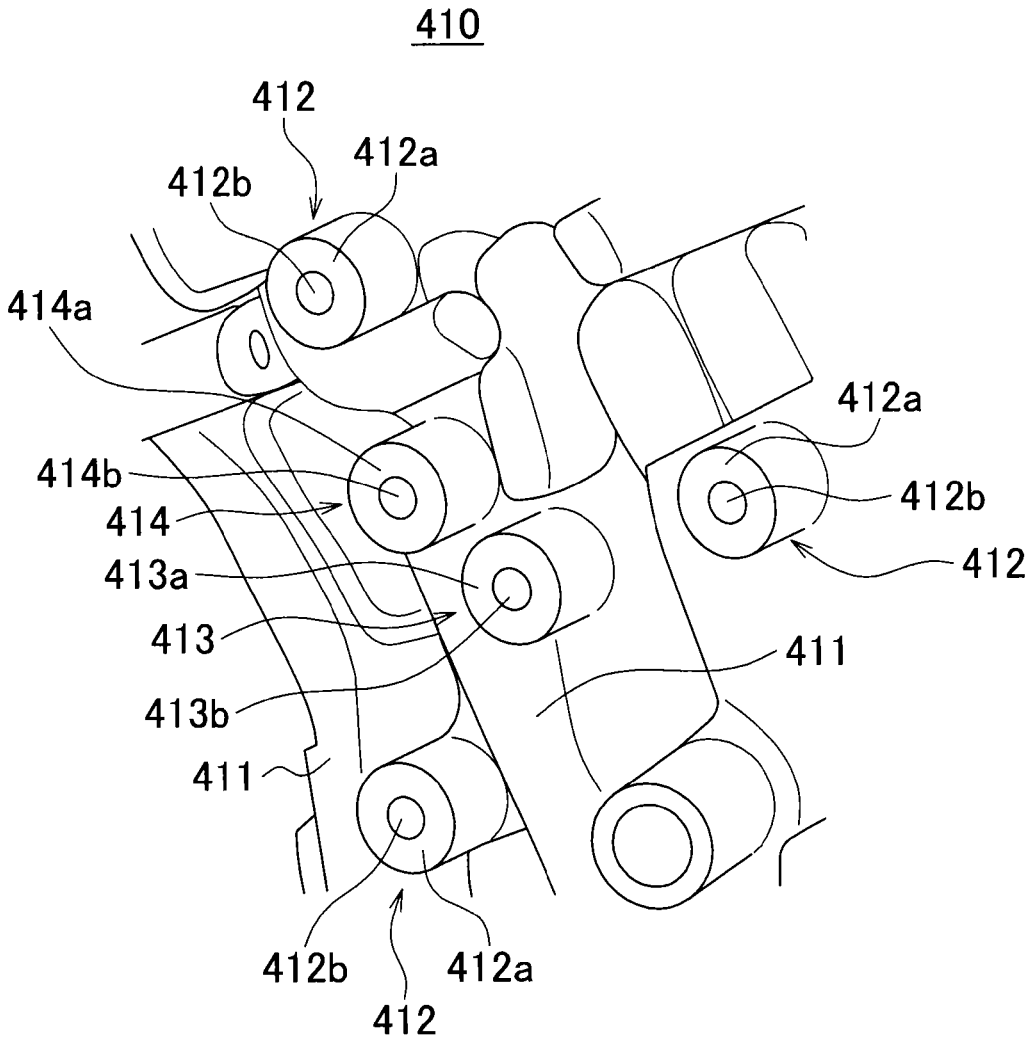
FIG. 8 is a perspective view illustrating a fitting target portion to which the electric oil pump is fitted.

In this embodiment, a fitting target portion to which the electric oil pump 100 is fitted is an outer surface portion of a case 410 of the transmission. As shown in FIG. 8, a plurality of ribs 411 is formed on the outer surface portion of the case 410 so that the case 410 has strength. Therefore, the outer surface portion of the case 410 is formed in an uneven shape.

Further, a plurality of bosses 412 is formed so as to protrude from the outer surface portion of the case 410. Each boss 412 is in the form of a block, and has a columnar shape in this embodiment. A distal end of each boss 412 is a fitting target surface 412*a* that is a flat surface. A screw hole 412*b* is formed at each fitting target surface 412*a*. Each fitting surface 19*b* (see FIG. 6) is in contact with the corresponding fitting target surface 412*a* and a fitting screw (not shown) inserted in each fitting hole 19*a* is screwed into the corresponding screw hole 412*b*, and thus, the second housing member 19 is fitted to the bosses 412.

The bosses 412 are formed in order to fit the second housing member 19 to the case 410 in a manner such that the second housing member 19 is spaced from the ribs 411 while avoiding the interference between the second housing member 19 and the ribs 411. If a space between the ribs 411 is filled with metal so that a fitting target surface to which the second housing member 19 is to be fitted is formed, the thickness of the case 410 is excessively increased. Therefore, "blowholes" may be formed during the casting of the case 410. The thickness of the case 410 is made small and the ribs 411 and the bosses 412 are formed on the case 410 in this embodiment. Therefore, the formation of "blowhole" during the casting of the case 410 is prevented and the case 410 has strength.

A suction boss 413 and a discharge boss 414 are formed so as to protrude from the outer surface portion of the case 410. Each of the suction boss 413 and the discharge boss 414 is in the form of a block and has a columnar shape. Contact surfaces 413*a*, 414*a*, which are flat surfaces, are formed at the distal ends of the suction boss 413 and the discharge boss 414, respectively. A suction port 413*b* and a discharge port 414*b* are formed at the contact surfaces 413*a*, 414*a*, respectively.

A packing such as an O-ring fitted to the packing fitting recess 19*q* (see FIG. 6) is in contact with the contact surface 413*a* of the suction boss 413. A packing such as an O-ring fitted to the packing fitting recess 19*r* (see FIG. 6) is in contact with the contact surface 414*a* of the discharge boss 414. The suction flow passage 19*c* and the suction port 413*b* communicate with each other. Further, the discharge flow passage 19*d* and the discharge port 414*b* communicate with each other.

The suction-side groove 19*e*, the discharge-side groove 19*f*, the suction-side relief recess 19*m*, and the discharge-side relief recess 19*n* of the second housing member 19 are formed by casting. Therefore, it is possible to form the shapes of the suction-side relief recess 19*m* and the discharge-side relief recess 19*n* with a high degree of freedom and at a low cost. The relief flow passage 19*i* and the spring receiving hole 19*j* are formed by drilling (cutting).

As described above, in the electric oil pump 100 (pump) of this embodiment, the protruding portion 19*h*, which protrudes in the thickness direction z, is formed on the reverse surface 19*v* of the second housing member 19 (housing) on which the fitting portions 19*u* are formed. Further, the relief valve 15 is provided in the protruding portion 19*h*.

As described above, the fitting portions 19*u* are fitted to the bosses 412 that are formed so as to protrude from the case 410 (fitting target portion), and thus, the second housing member 19 is fitted to the case 410. That is, a space is present between the second housing member 19 and the case 410. Further, the protruding portion 19*h*, which is formed on the reverse surface 19*v* of the second housing member 19, is disposed in the space so as to overlap with the bosses 412 in the thickness direction. Furthermore, since the relief valve 15 is provided in the protruding portion 19*h*, the increase of the thickness of the electric oil pump 100 is prevented.

As shown in FIGS. 4 and 5, the suction-side relief recess 19*m* is formed at the bottom of the suction-side groove 19*e*. Further, the discharge-side relief recess 19*n* is formed at the bottom of the discharge-side groove 19*f*. Furthermore, the relief flow passage 19*i*, which provides communication between the suction-side relief recess 19*m* and the discharge-side relief recess 19*n*, is formed in the protruding portion 19*h* and in the portion of the second housing member 19 corresponding to the position at which the protruding portion 19*h* is formed in the plane direction.

Since the protruding portion 19*h*, which overlaps with the bosses 412 in the thickness direction z, is a member that forms the relief flow passage 19*i* as described above, the second housing member 19 is not made thick. Therefore, the increase of the thickness of the electric oil pump 100 is prevented.

Further, as shown in FIG. 5, the bottom 19*s* of the discharge-side relief recess 19*n* is gradually inclined toward the portion of the relief flow passage 19*i* connected to the suction-side relief recess 19*m*, in the direction toward the lower side in the thickness direction of the second housing member 19. Similarly, the bottom 19*t* of the suction-side relief recess 19*m* is gradually inclined toward the portion of the relief flow passage 19*i* connected to the discharge-side relief recess 19*n*, in the direction toward the lower side in the thickness direction of the second housing member 19.

The discharge-side groove 19*f* is smoothly connected to the relief flow passage 19*i* by the discharge-side relief recess 19*n*, and thus, the flow passage from the discharge-side groove 19*f* to the relief flow passage 19*i* is not suddenly changed. Similarly, the suction-side groove 19*e* is smoothly connected to the relief flow passage 19*i* by the suction-side relief recess 19*m*, and thus, the flow passage from the suction-side groove 19*e* to the relief flow passage 19*i* is not suddenly changed.

Accordingly, when the relief valve 15 is operated and oil flows to the suction-side relief recess 19*m* from the discharge-side groove 19*f* through the relief flow passage 19*i*, the flow direction of oil is not suddenly changed, and thus, it is possible to prevent the pressure loss of flowing oil. Therefore, it is possible to prevent the occurrence of chattering in which the operation and non-operation of the relief valve 15 are repeated, when hydraulic pressure in the discharge-side groove 19*f* is equal to or higher than the opening pressure.

Further, in this embodiment, the suction-side relief recess 19*m* and the discharge-side relief recess 19*n* are formed by casting. Accordingly, it is possible to form the shapes of the suction-side relief recess 19*m* and the discharge-side relief recess 19*n* with a high degree of freedom. Therefore, it is possible to form the suction-side relief recess 19*m* and the discharge-side relief recess 19*n* in the shapes that do not cause the sudden change in the flow direction of oil. Furthermore, since the degree of freedom in determining the positions where the suction-side relief recess 19*m* and the discharge-side relief recess 19*n* are formed is high, it is easy to set the opening pressure for the relief valve 15. Moreover, it is possible to form the suction-side relief recess 19*m* and the discharge-side relief recess 19*n*, which have the above-mentioned shapes, at a low cost.

Since the electric oil pump 100 is into contact with only the bosses 412 and the electric oil pump 100 and the case 410 are spaced from each other, the transfer of heat to the electric oil pump 100 from the case 410 is minimum. Therefore, the electric oil pump 100 is not overheated by heat generated by the transmission, and thus, an electronic circuit (not shown) provided in the electric oil pump 100 is protected from the heat.

In the above-mentioned embodiment, an urging member, which presses the spool 16 to the bottom of the receiving portion 19*p* and urges the spool 16 in a direction in which the relief flow passage 19*i* is closed by the spool 16, is the spring 18. However, an elastic member such as rubber may be used as the biasing urging in an embodiment.

The electric oil pump 100 according to the embodiment, in which the inner rotor 12 is rotated by the motor 20 (see FIG. 2), has been described above as the pump of the invention. However, the pump may be a mechanical pump without the motor 20. Further, the pump according to the embodiment, which supplies oil as fluid, has been described above. However, the pump may be a pump that supplies fluid such as water.

What is claimed is:

1. A pump that is fitted to bosses protruding from a fitting target portion, the pump comprising:

a housing having an interior in which a pump chamber that is a columnar space is defined, and a suction-side groove and a discharge-side groove are formed at a predetermined interval in a circumferential direction of a bottom of the pump chamber so as to be recessed in the bottom of the pump chamber;

an outer rotor provided in the pump chamber for rotation about an axis of rotation, and includes internal teeth formed at an inner peripheral side of the outer rotor;

an inner rotor that is provided inside the internal teeth, the inner rotor including external teeth that mesh with the internal teeth and are formed at an outer peripheral side of the inner rotor;

fitting portions, that are fitted to the bosses, formed on an outer surface of the housing, which outer surface is spaced from the housing interior in a thickness direction of the housing and which thickness direction is parallel to the direction of the axis of rotation, to protrude outward in the direction of the axis of rotation such that the fitting portions cause the outer surface of the housing to protrude farther away from the housing interior in the direction of the axis of rotation at locations of the fitting portions;

a space provided between the fitting target portion and the housing, by the protruding fitting portions and the protruding bosses, the space extending in the direction of the axis of rotation;

a protruding portion protruding outward from the housing in the direction of the axis of rotation and into said space; and a relief valve provided in the protruding portion, wherein the relief valve discharges fluid from the discharge-side groove when pressure in the discharge-side groove is equal to or higher than predetermined pressure.

2. The pump according to claim 1, wherein a suction-side relief recess is formed at a bottom of the suction-side groove, a discharge-side relief recess is formed at a bottom of the discharge-side groove, the protruding portion is a member that forms a relief flow passage communicating with the suction-side relief recess and the discharge-side relief recess, and the relief valve includes the suction-side relief recess, the discharge-side relief recess, the relief flow passage, and a spool that closes or opens the relief flow passage.

* * * * *